US010815097B2

(12) United States Patent
Moore et al.

(10) Patent No.: US 10,815,097 B2
(45) Date of Patent: Oct. 27, 2020

(54) PAYOUT TUBES

(71) Applicant: REELEX Packaging Solutions, Inc., Patterson, NY (US)

(72) Inventors: Brian Moore, Wallkill, NY (US); Timothy Copp, New Milford, CT (US)

(73) Assignee: REELEX Packaging Solutions, Inc., Patterson, NY (US)

( * ) Notice: Subject to any disclaimer, the term of this patent is extended or adjusted under 35 U.S.C. 154(b) by 0 days.

(21) Appl. No.: 16/352,344

(22) Filed: Mar. 13, 2019

(65) Prior Publication Data

US 2020/0290841 A1 Sep. 17, 2020

(51) Int. Cl.

| | |
|---|---|
| ***B65H 49/08*** | (2006.01) |
| ***B65D 85/676*** | (2006.01) |
| ***B65H 55/04*** | (2006.01) |
| ***B65H 57/12*** | (2006.01) |

(52) U.S. Cl.
CPC ..... *B65H 49/08* (2013.01); *B65D 85/676* (2013.01); *B65H 55/046* (2013.01); *B65H 57/12* (2013.01)

(58) Field of Classification Search
CPC ..... B65H 55/046; B65H 57/12
See application file for complete search history.

(56) References Cited

U.S. PATENT DOCUMENTS

| | | | | |
|---|---|---|---|---|
| 3,693,784 | A | 9/1972 | Holmes | |
| 4,009,845 | A | 3/1977 | Santucci et al. | |
| 4,057,203 | A | 11/1977 | Newman et al. | |
| 5,520,347 | A * | 5/1996 | Bass | B65H 49/08 242/157 R |
| 6,341,741 | B1 | 1/2002 | Kotzur et al. | |
| 6,702,213 | B2 | 3/2004 | Kotzur et al. | |
| 2013/0161432 | A1 | 6/2013 | Manella et al. | |
| 2015/0259131 | A1 | 9/2015 | Weissbrod | |
| 2017/0043974 | A1 | 2/2017 | Moore | |

OTHER PUBLICATIONS

Search Report and Written Opinion dated Jun. 5, 2020 of International Application No. PCT/US20119859.

* cited by examiner

*Primary Examiner* — William E Dondero

(74) *Attorney, Agent, or Firm* — Gordon & Jacobson, P.C.

(57) ABSTRACT

A payout tube has an inner end and an outer end. The inner end is disposable in an interior of a coil of filamentary material wound in a figure-eight configuration defining a payout hole. The outer end is configured to extend outwardly from the payout hole of the coil. The payout tube has a flange at the outer end and has a rounded edge at the inner end. The rounded edge has a radius between 0.20 and 0.30 inch. In some embodiments, the payout tube includes a tubular body that extends between the flange and the rounded edge. In other embodiments, the payout tube includes an outer ring having the flange, an inner ring having the rounded edge with the inner and outer rings aligned coaxially about a longitudinal axis in spaced relation, and a plurality of pillars extending longitudinally from the outer ring to the inner ring.

12 Claims, 6 Drawing Sheets

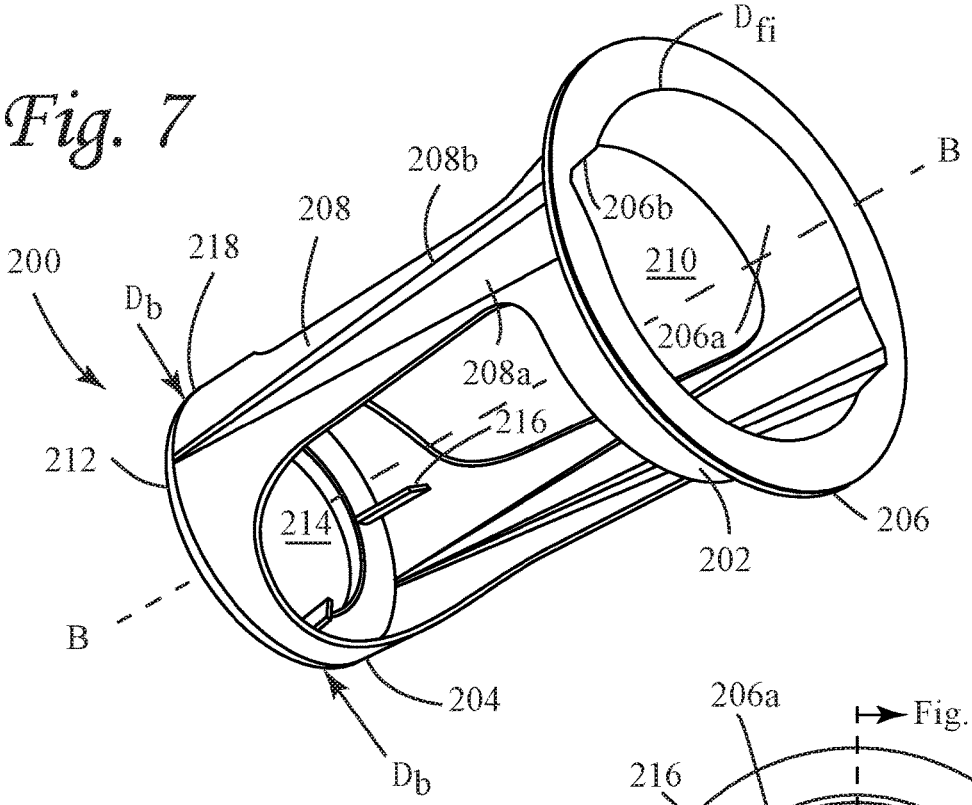
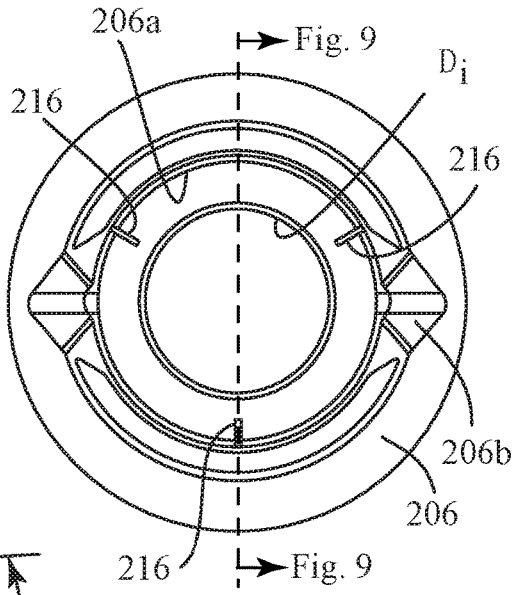
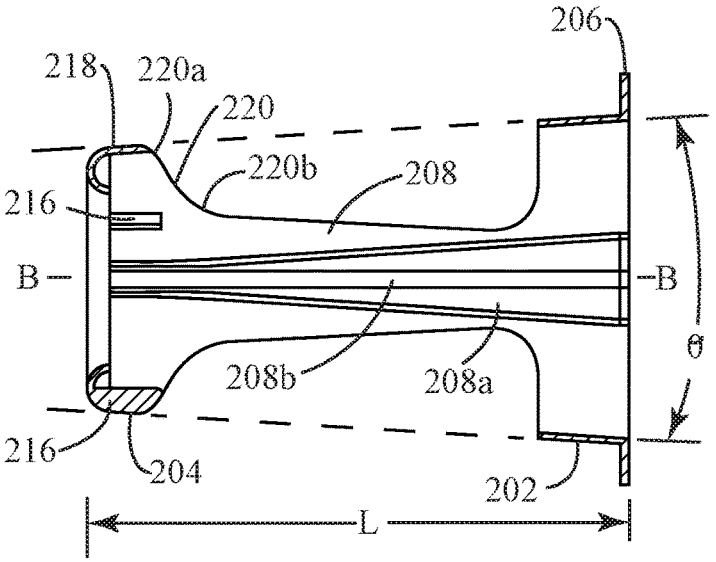
Fig. 9

PAYOUT TUBES

BACKGROUND

1. Field

The present disclosure relates to payout tubes for guiding filamentary material through payout holes of packages of wound coils of filamentary material.

2. State of the Art

Payout tubes for performing the function of guiding filamentary material through payout holes of packages of wound coils are known to the art. For example, U.S. Pat. Nos. 6,702,213 and 6,341,741, both to Kotzur et al., describe a payout tube for insertion in a radial hole of a wound coil of filamentary material, where the radial hole extends from the inner to the outer wind of the wound coil. The payout tube includes an entrance and an exit opening in coaxial and spaced relationship with one another.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Payout tubes are described for facilitating payout of filamentary material from a coil of filamentary material wound in a figure-eight configuration and defining a payout hole. The payout hole is generated in the figure-eight winding and extends from an inner wind layer of the coil to an outer wind layer of the coil.

According to one embodiment, the payout tube includes a flange at an outer end of the payout tube, which is located adjacent to and/or outside a box or other packaging for the coil. The flange is centered about a longitudinal axis through an opening defined by flange. The payout tube also includes a tubular body extending longitudinally from the flange to an inner end of the payout tube. The tubular body is aligned coaxially with the flange, and the tubular body has a rounded edge at the inner end of the payout tube. The rounded edge has a radius of between 0.20 and 0.30 inches; e.g., 0.25 inch. In embodiments, the rounded edge has a half-round profile.

In embodiments, the tubular body tapers down in diameter from the flange to the rounded edge. A taper angle of the tubular body may be less than 10 degrees. In embodiments, a length of the payout tube along the longitudinal axis between the inner end and the outer end is between 5 and 8 inches, e.g., about 6 inches. In embodiments, an inner diameter of the flange defines an exit opening through which filamentary material can pass through, the exit opening having a diameter of between 3.5 inches and 4 inches.

In embodiments, the tubular body may have a wall of uniform thickness, which may be 0.045 inch. The tubular body may be made from plastic or pulp paper.

According to another embodiment, the payout tube includes an outer ring centered about a longitudinal axis and having a flange at an outer end of the payout tube. The payout tube also includes an inner ring having a rounded edge at an inner end of the payout tube, and a plurality of spaced pillars are provided extending longitudinally from the outer ring to the inner ring. The inner ring is aligned coaxially with the outer ring and is spaced longitudinally from the outer ring.

In embodiments, the rounded edge of the inner ring has a radius of between 0.20 and 0.30 inches, e.g., 0.25 inch and may have a half-round profile. In embodiments, each pillar includes a stiffener which may have a tapered, e.g., substantially V-shaped profile. In embodiments, the substantially V-shaped profile protrudes from an exterior side of the pillar and is indented on an interior side of the pillar. The V-shaped profile tapers along a longitudinal direction of the pillar so that it is widest adjacent the outer ring and narrowest adjacent the inner ring. In embodiments, the payout tube includes two diametrically opposed pillars.

According to another aspect of the disclosure, a package of filamentary material may include a box or other packaging defining a payout hole, a coil of filamentary material wound into a figure-eight configuration defining a diamond shaped payout hole in alignment with the payout hole of the box or other packaging, and any of the embodiments of payout tubes described herein. In embodiments, a box having a length of 14 to 15 inches, a width of 9 to 10 inches, and height of 14 to 15 inches is provided without the payout hole located central to a rectangular side, although boxes of other dimensions may be provided.

BRIEF DESCRIPTION OF THE DRAWINGS

FIG. 7 shows a perspective view of another embodiment of a payout tube.

FIG. 8 shows a front elevation view of the payout tube of FIG. 7.

FIG. 9 shows a side elevation view of the payout tube of FIG. 7.

DETAILED DESCRIPTION OF THE PREFERRED EMBODIMENTS

Figure 1:
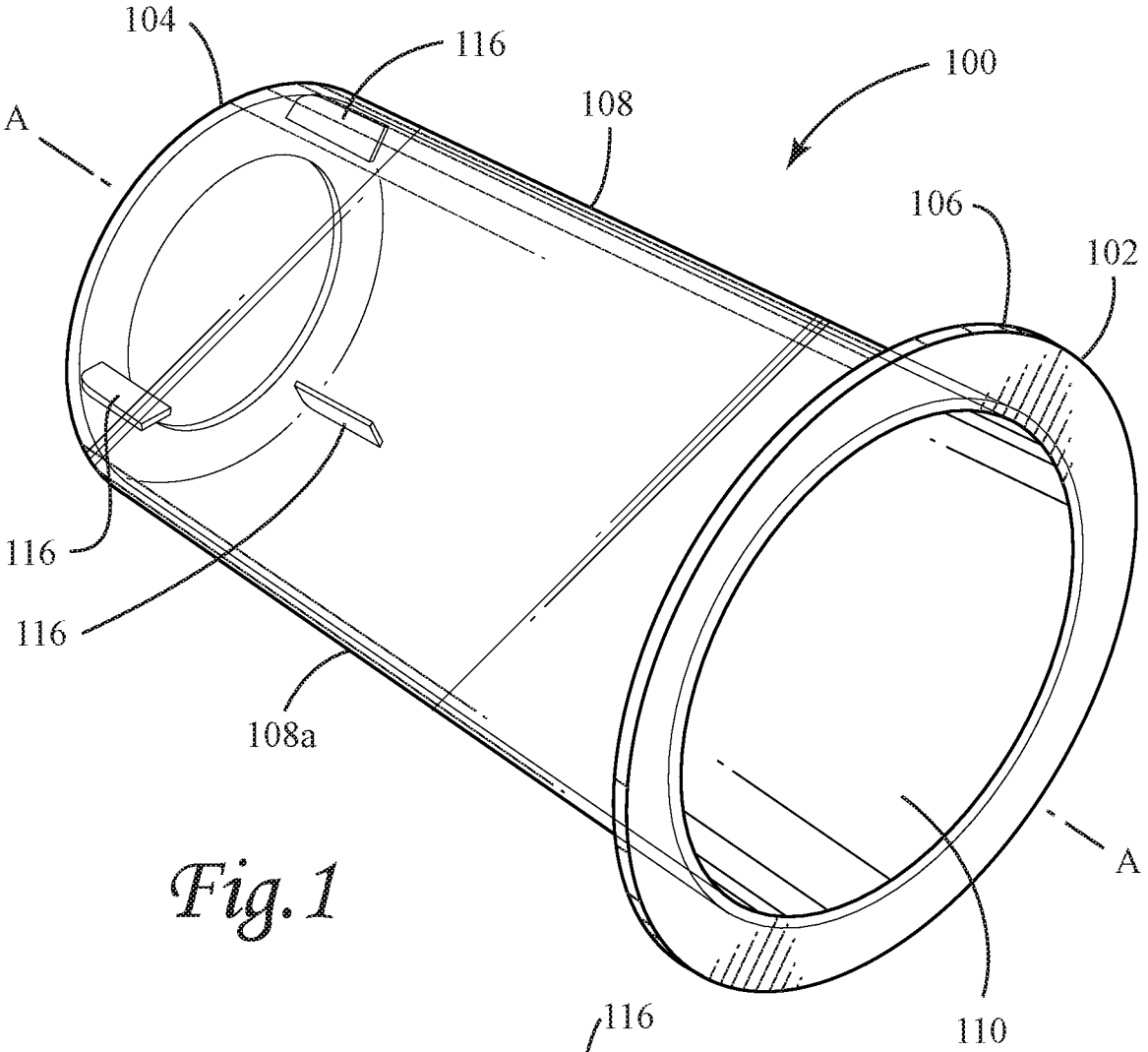
FIG. 1 is a perspective view of an embodiment of a payout tube in accordance with the disclosure.

FIG. 1 shows a payout tube 100 in accordance with an aspect of the disclosure. The payout tube 100 may be made from various materials, included plastic or pulp paper. The payout tube 100 has an outer end 102 and an inner end 104. As used herein, "inner" and "outer" refer to location of the ends 102, 104 when the payout tube 100 is inserted in a package including a coil of wound filamentary material. That is, when the payout tube 100 is inserted into a coil, the inner end 108 will be located in a space defined by the coil (i.e., interior of the coil), while the outer end 106 will be located outside (exterior) the coil. In preferred embodiments, the coil is a coil of filamentary material wound in a figure-eight configuration, such as described in U.S. Pat. Nos. 6,702,213 and 6,341,741, the entire contents of both of which are incorporated herein by reference.

The payout tube 100 includes a flange 106 at the outer end 102, and an elongated tubular body 108 that extends longitudinally from the flange 106, along an axis A-A, to the inner end 104. The flange 106 is coaxial with the tubular body 108. In the embodiment shown, the tubular body 102 has a tapered wall 108*a* of uniform thickness, which may be about 0.045 inch.

Figure 2:
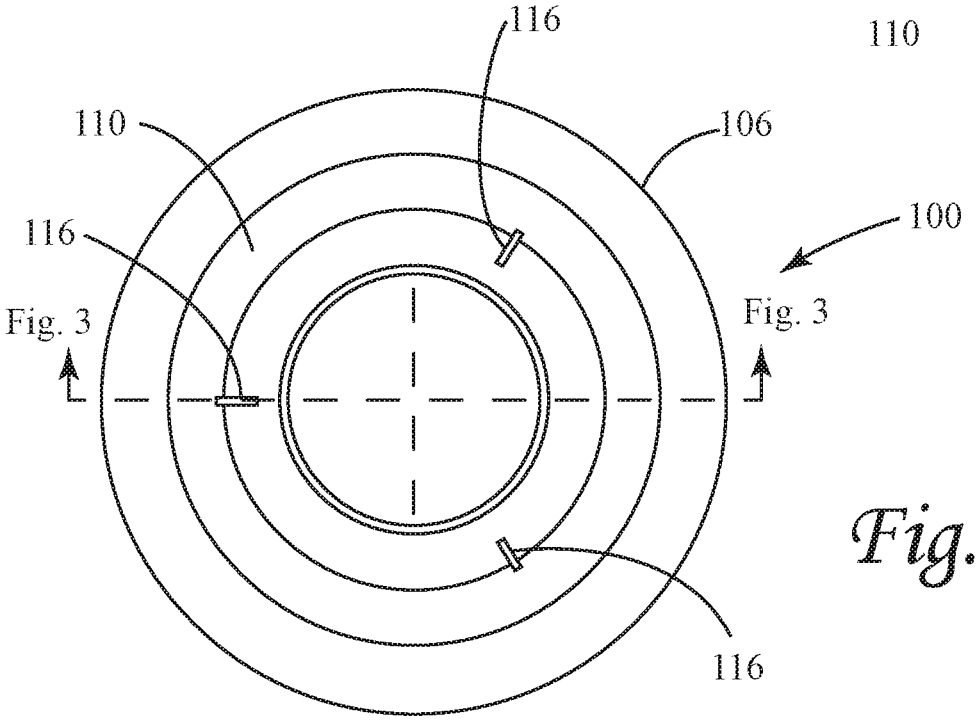
FIG. 2 is a front elevation view of the payout tube of FIG. 1.
Figure 3:
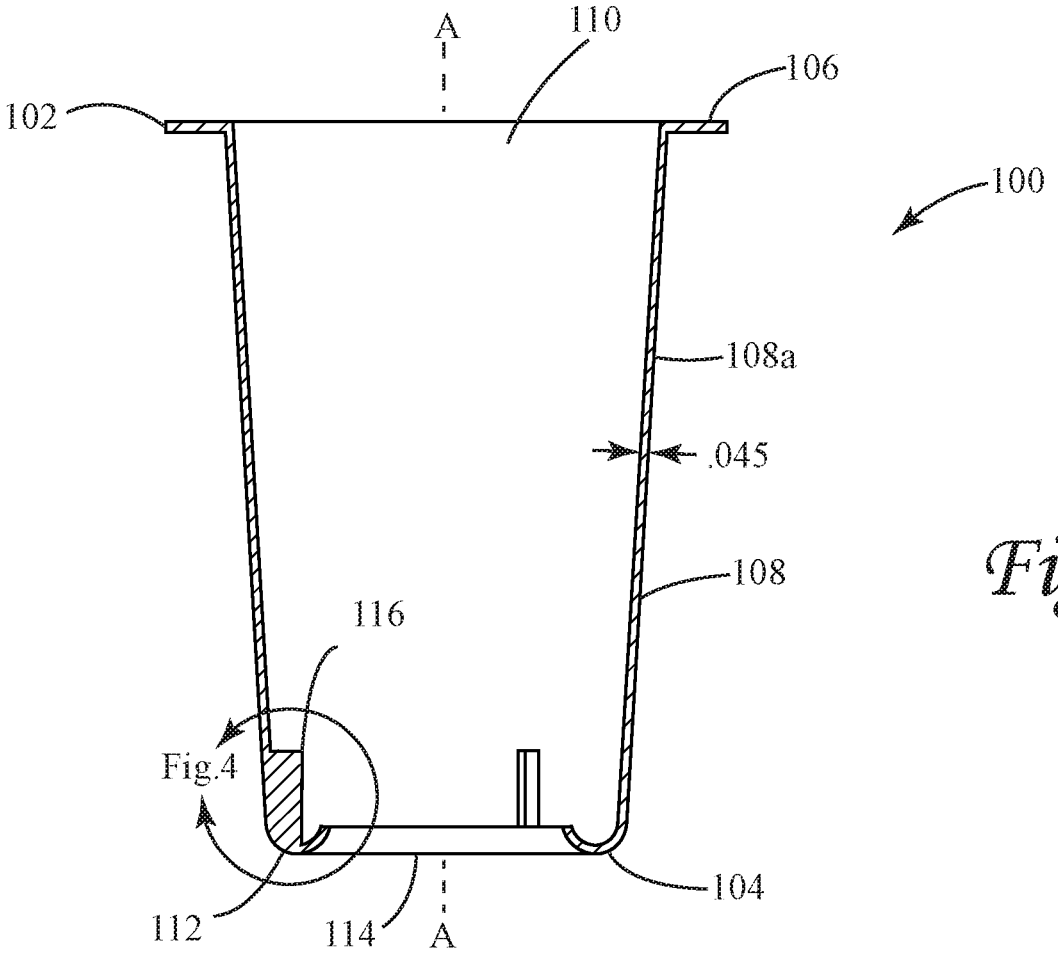
FIG. 3 shows the payout tube of FIG. 1 along section 3-3 in FIG. 2.

As shown in FIGS. 1, 2, and 3, the flange 106 extends radially outwardly from the body 108. The flange 106 has an inner diameter that defines an exit opening 110 through which filamentary material passes during payout. In one embodiment, the diameter $D_{fi}$ (FIG. 5) of the exit opening 110 may be between 3.5 inches and 4 inches, and the flange 106 may have an outer diameter, $D_{fo}$ (FIG. 6) of between 4.3 inches and 4.8 inches. In the embodiment shown, the outer diameter $D_{fo}$ of the flange 106 is approximately 4.6 inches.

Figure 4:
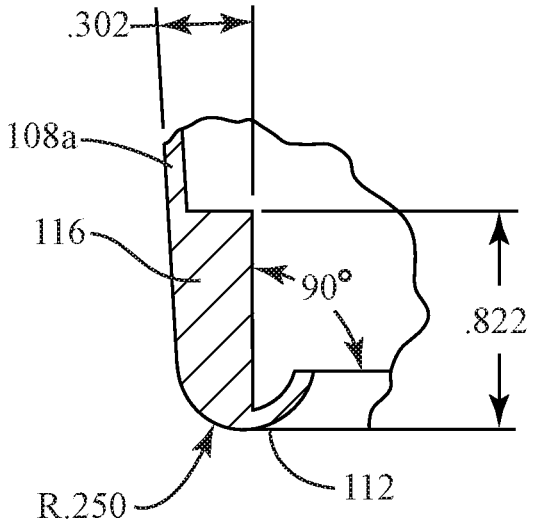
FIG. 4 shows detail C shown in FIG. 3.

At the inner end 104 of the payout tube 100, the wall 108*a* of the tubular body 108 is rounded radially inwardly towards the axis A-A forming a half-round profile or edge 112, shown in greater detail in FIG. 4. The radius of the profile may be between 0.20 inch and 0.30 inch. In the embodiment shown in FIGS. 1 to 4, the radius of the profile is approximately 0.25 inch. The half-round edge 112 defines an inlet opening 114 (FIG. 3) at the inner end 106 of the payout tube 100. In one embodiment, the inlet opening 114 may have an inlet diameter, $D_i$ (FIG. 6), of between 1.75 inch and 2.25 inches. In the embodiment of payout tube 100 shown in FIGS. 1 to 6, the inlet diameter, $D_i$, is approximately 1.92 inch. The inlet diameter, $D_i$, is noticeably smaller (about 32% smaller) than the inner diameter $D_b$ (FIG. 5) of the tubular body 108 at the base 118 of the rounded edge 112, which in the embodiment of the payout tube 100 is approximately 2.82 inches.

During payout of filamentary material from a coil of filamentary material wound in a figure-eight configuration, the payout tube 100 sits in an opening formed in the coil and filamentary material enters the payout tube 100 through the inlet opening 114 and exits the exit opening 110. The rounded edge 112 with a desired radius of between 0.20 and 0.30 inch at end 104 provides a smooth edge against which filamentary material contacts the payout tube 100 as it enters the inlet opening 114. Because of the desired radius, the rounded edge 112 facilitates an easier sliding of the filamentary material along the edge 112 during payout. For example, some portions of filamentary material payed out may have small kinks or irregularities at locations along their length. Such kinks or irregularities may slide more easily over the rounded edge 112 of the desired radius than if the edge is sharper as in the prior art.

Standoffs 116 (FIGS. 2, 3, and 4) may be located on an inner side of the wall 108*a* of the tubular body 108 and may be located at or near the inner end 104. In the example embodiment shown, three standoffs 116 are included and are spaced circumferentially 120 degrees apart from one another about axis A-A. While three standoffs 116 are shown in the embodiment of the payout tube 100, more or fewer standoffs may be present. The standoffs 116 maintain a certain amount of axial spacing between adjacent payout tubes 100 when they are stacked or nested one inside one another. This spacing can mitigate adjacent stacked payout tubes 100 from "sticking" or otherwise tightly wedging themselves together when stacked.

Figure 5:
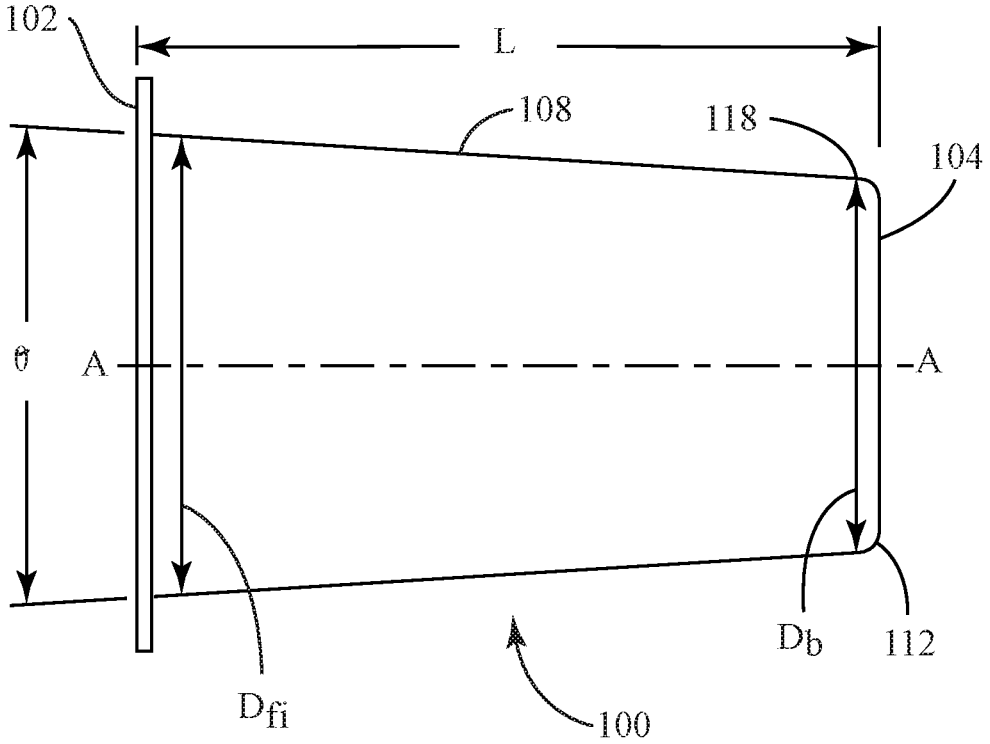
FIG. 5 shows a side elevation view of the payout tube of FIG. 1.
Figure 6:
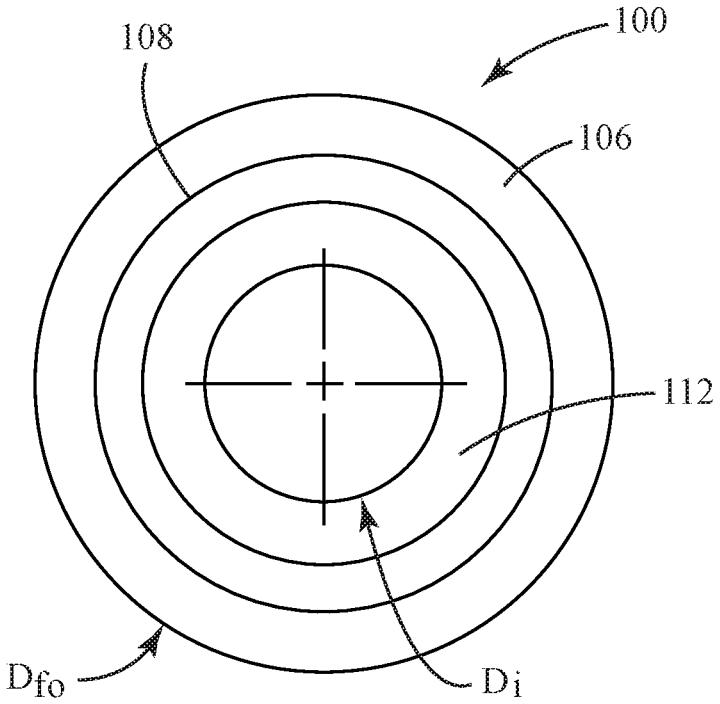
FIG. 6 shows a rear elevation view of the payout tube of FIG. 1.

FIGS. 5 and 6 show additional details of the payout tube 100 of FIG. 1. The payout tube 100 may have an axial length, L (FIG. 5), of about 6 inches. A taper angle Θ (FIG. 5) of the body 108 is relatively shallow and may, in one embodiment, be less than 10 degrees. In the embodiment shown, the taper angle, Θ, of the body 108 is approximately 7 degrees. Also, in embodiments, the tubular body 108 tapers down to an outer diameter at the base 118 of the rounded edge 112 of about 2.75 to 3.25 inches. In the embodiment shown in FIG. 5, the tubular body 108 tapers to an outer diameter of approximately 2.9 inches at the base 118 of the rounded edge 112.

Turning now to FIGS. 7 to 10C, another payout tube 200 is seen. The payout tube 200 may be formed from plastic or pulp paper and may have a uniform wall thickness. Payout tube 200 may have a rounded edge 212, which is the same as edge 112 of payout tube 100, i.e., having a radius of between 0.20 and 0.30 inches such as 0.25 inch. The overall dimensions of the payout tube 200 (e.g., length, inlet and outlet diameters, and taper angle) may be the substantially the same as those for payout tube 100, although the payout tube 200 differs from payout tube 100 in other ways. In particular, the payout tube 200 includes an outer tubular ring 202 having a flange 206, an inner tubular ring 204 having the rounded edge 212 or profile, and elongated pillars 208 connecting the outer and inner tubular rings 202 and 204 in coaxially spaced relation along axis B-B. Two diametrically opposed pillars 208 are shown in the embodiment in FIG. 7, although additional spaced pillars may be used in other embodiments.

The pillars 208 are stiffened by substantially "V" shaped stiffening ribs 208*a*, which protrude along the outer surfaces of the pillars 208, as shown in FIG. 7. A corresponding substantially V-shape profile is indented on the inside surfaces of the pillars 208 so that a uniform wall thickness is maintained. The ribs 208*a* extend axially between the flange 206 and the rounded edge 212, though the ribs 208*a* need not terminate at either the flange 206 or the rounded edge 212. In the example embodiment, the indent of the substantially V-shaped profile extends to the flange 206 such that an inner edge 206*a* (FIGS. 7 and 9) of the flange 206 has diametrically opposed substantially V-shaped indents 206*b* (FIGS. 7 and 9) corresponding to the indented profiles on the inside surfaces of the pillars 208. The substantially V-shaped profile of the ribs 208*a* is wider towards the flange 206 than towards the rounded edge 212. The ribs 208*a* have a central ridge 208*b* which is rounded and not sharp. This rounded ridge 208*b* is intended to prevent any pinching or kinking of filamentary material in contact with the ridge 208*b*. It is noted that the substantially V-shaped tapered stiffening ribs do not taper to a point at the inner end, but rather have a narrow non-tapered end as seen best in FIG. 9.

In addition to stiffening the payout tube 200, the ribs 208*a* also provide a keyed locating feature for inserting the payout tube 200 into a payout hole of a figure-eight wound coil of filamentary material. Specifically, a wound coil that has been wound in a figure-eight configuration may have a diamond-shaped payout hole. The protruding V-shaped ribs 208*a* on the exterior sides of the pillars 208 are configured to vertically align with upper and lower vertices of a diamond shaped payout hole.

Standoffs 216 (FIGS. 7, 8, and 9) may also be located on an inner side of the inner ring 204 and may be located at or near the rounded edge 212. In the example embodiment shown, three standoffs 216 are included and are spaced circumferentially 120 degrees apart from one another about axis B-B. While three standoffs 216 are shown in the embodiment of the payout tube 200, more or fewer standoffs may be present. The standoffs 216 maintain a certain amount of axial spacing between adjacent payout tubes 200 when they are stacked or nested inside one another. This separation can mitigate adjacent stacked payout tubes 200 from "sticking" or otherwise tightly wedging themselves together when stacked.

When the payout tube 200 is disposed in a payout hole of a coil of filamentary material wound in a figure-eight configuration, the filamentary material will typically compress into spaces between the inner ring 204, the outer ring 202, and the pillars 208. Filamentary material located in these spaces, when eventually paid out, will have to move out of the spaces and contact an edge 220 (FIGS. 7 and 9) before being drawn through inlet opening 214 (FIG. 7). The edge 220 is comprised of a compound curve having a convex portion 220*a* and a concave portion 220*b*. The convex portion 220*a* is located at a radially outermost location of pillar 208, while the concave portion 220*b* is located radially closer to axis B-B, as shown in FIG. 9. The edge 220 is thus gently curved and smooth so that the filamentary material in the spaces between inner and outer rings 204, 202, and the pillars 208 can more easily slide along the edge 220 without kinking or getting caught on the edge 220.

As previously mentioned, some of the dimensions of the payout tube 200 may be the same as the dimensions as the payout tube 100. For example, the inner edge 206*a* of the flange 206 defines an exit opening 210 having a diameter $D_{fi}$ (FIG. 7), which may have the same dimension as the diameter $D_{fi}$ of the exit opening 110 of the payout tube 100. Also, the inner and outer rings 202 and 204 are tapered and define a taper angle Θ (FIG. 9) of the payout tube 200 that may have the same dimension as the taper angle Θ of the payout tube 100. The rounded edge 212 defines an inlet opening 214 having a diameter $D_i$ (FIG. 9), which may have the same dimension as the diameter $D_i$ of the inlet opening 114 of the payout tube 100. An outer diameter $D_b$ (FIG. 7) of the inner ring 204 at the base 218 of the rounded edge 212 may have the same dimension as the outer diameter $D_b$ of the tubular body 108 at the base 118 of the rounded edge 112 of the payout tube 100. Also, the payout tube 200 has a length L (FIG. 9) measured along axis B-B, which may have the same dimension as the length L of the payout tube 100.

Figure 10A:
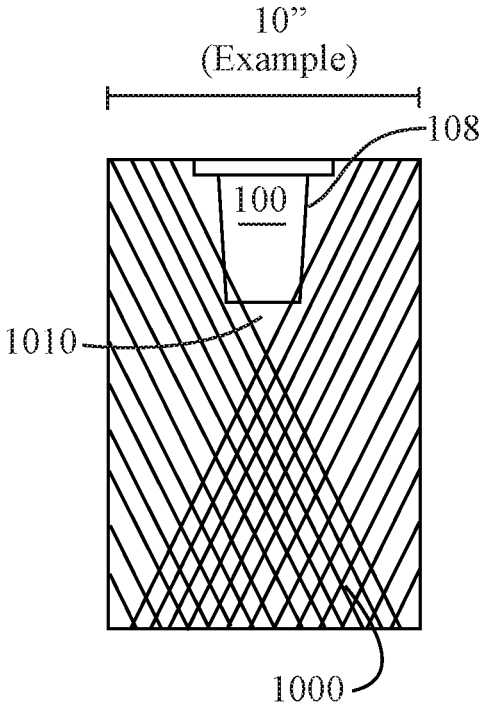
FIG. 10A shows a schematic side view of the payout tube of FIG. 1 in a payout hole of a wound figure-eight coil.
Figure 10B:
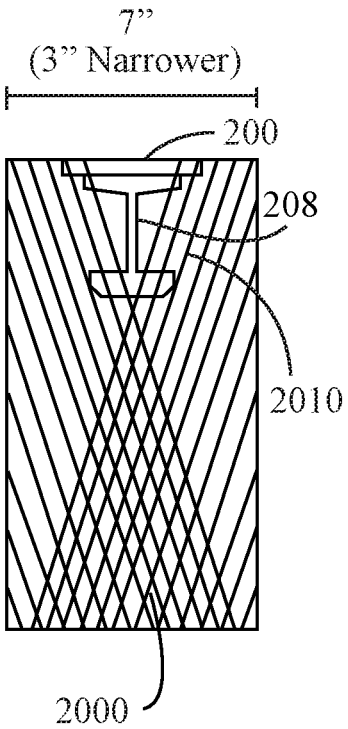
FIG. 10B shows a schematic side view of the payout tube of FIG. 7 in a payout hole of another wound figure-eight coil, showing a reduction in width of the coil compared to the coil in FIG. 10A.
Figure 10C:
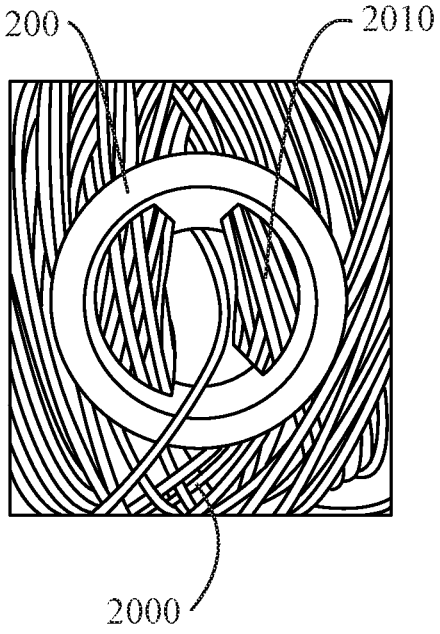
FIG. 10C shows a front view of the arrangement shown in FIG. 10B.

The payout tube 200, when compared to payout tube 100, eliminates a significant amount of material from the body 108. FIG. 10A shows payout tube 100 inserted into a coil 1000 of filamentary material 1010 wound in a figure-eight configuration. As shown in FIG. 10A, because the wall 108*a* of body 108 is solid, the filamentary material 1010 cannot be located in the space occupied by the payout tube 100. As a result, the coil 1000 (and its box) is dimensioned to be wider than necessary to accommodate the width of the payout tube 100. In contrast, as shown in FIGS. 10B and 10C, when the tube 200 is inserted into a coil 2000 of filamentary material 2010, the coil width can be narrower than the width of the coil shown in FIG. 10A, because filamentary 2010 material can be located in the open spaces around the pillars 208 of the payout tube 200 which spaces are otherwise closed for payout tube 100. Indeed, when using the tube 200, the coil 2000 can compress significantly, and thus reduce the overall width of the coil and its box. The reduced dimensions of the box can allow for a 30 to 40 percent increase in shipping density depending on the size of the box. For example, a typical box that holds a figure-eight wound coil of Category 6A cable has dimensions of 16 inches×16 inches×10 inches, and such coil can accommodate the payout tube 100 described above. The use of payout tube 200 allows for a coil (and box) of smaller dimension so that an additional 2 to 4 boxes per layer to be placed on a shipping pallet as compared to the example box.

Figure 11A:
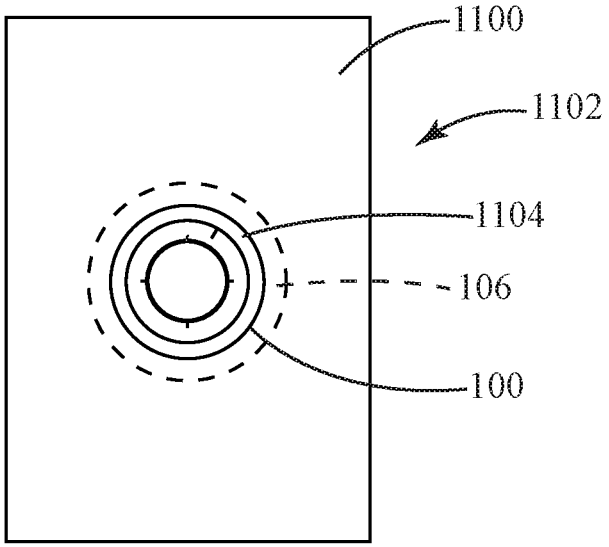
FIG. 11A shows a front view of a package of filamentary material using the payout tube of FIG. 1.
Figure 11B:
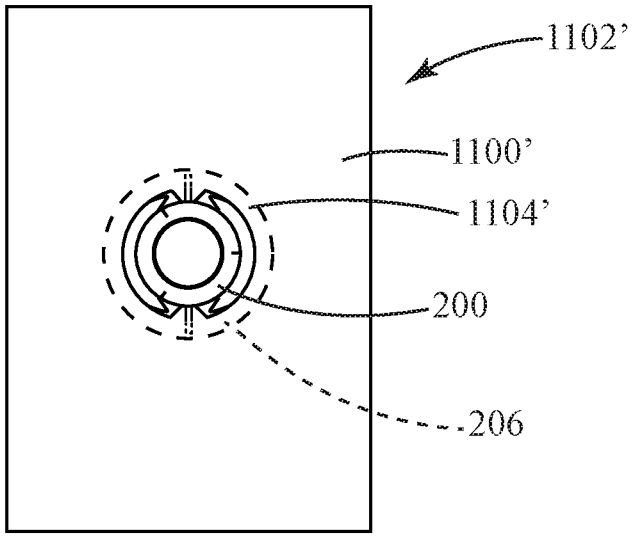
FIG. 11B shows a front view of a package of filamentary material using the payout tube of FIG. 7.

Turning to FIGS. 11A and 11B, packages 1102, 1102' are provided including boxes 1100, 1100' containing figure-eight wound filamentary material (not shown) into which payout tubes 100, 200 are inserted. In FIG. 11A, the filamentary material (not shown) is packaged in a box 1100 having a length that is 14 to 15 inches, a width that is 9 to 10 inches, and height that is 14 to 15 inches. Boxes of other dimensions may be utilized. The box 1100 may be constructed as described in U.S. Pat. Nos. 6,341,741 and 6,702,213. FIG. 11A shows the box 1100 defining a payout hole 1104 in a rectangular side of the box 1100, and the payout tube 100. The coil defines a payout hole that aligns with the payout hole 1104 of the box 1100 and with the axis A-A (FIGS. 1, 3, and 5) of the payout tube 100. The inner end of the payout tube 100 is disposed in an interior of the coil and the flange 106 is located adjacent to the rectangular side of the box 1100 (e.g., captured between two flaps of the rectangular side).

FIG. 11B shows a box 1100' (FIG. 11B) having a length that is 14 to 15 inches, a width that is 9 to 10 inches, and height that is 14 to 15 inches. Boxes of other dimensions (e.g., smaller as noted above) may be utilized. The box 1100' may be constructed as described in U.S. Pat. Nos. 6,341,741 and 6,702,213. Box 1100' defines a payout hole 1104' in a rectangular side of the box 1100' into which payout tube 200 extends. Figure-eight wound filamentary material (not shown) contained inside the box defines a payout hole that aligns with the payout hole 1104' of the box 1100' and with the axis B-B (FIGS. 7 and 9) of the payout tube 200. The inner end of the payout tube 200 is disposed in an interior of the coil and the flange 206 is located adjacent to the rectangular side of the box 1100' (e.g., captured between two flaps of the rectangular side).

There have been described and illustrated herein several embodiments of a payout tube. While particular embodiments of the invention have been described, it is not intended that the invention be limited thereto, as it is intended that the invention be as broad in scope as the art will allow and that the specification be read likewise. Thus, while particular dimensions have been disclosed, it will be appreciated that other larger or smaller proportional dimensions may be used as well. In addition, while particular types of materials for the construction of the payout tube have been disclosed, it will be understood that other suitable materials can be used. For example, and not by way of limitation, metal. It will therefore be appreciated by those skilled in the art that yet other modifications could be made to the provided invention without deviating from its spirit and scope as claimed.

What is claimed is:

1. A payout tube for facilitating payout of filamentary material from a coil of filamentary material wound in a figure-eight configuration and defining a payout hole, the payout hole extending from an inner wind of the coil to an outer wind of the coil, the payout tube comprising:

an outer ring having a flange at an outer end of the payout tube, the outer ring centered about a longitudinal axis;

an inner ring having a rounded edge at an inner end of the payout tube, wherein the inner ring is aligned coaxially with the outer ring and is spaced longitudinally from the outer ring; and a plurality of spaced pillars extending longitudinally from the outer ring to the inner ring.

2. The payout tube according to claim 1, wherein:

the rounded edge has a radius of between 0.20 inch and 0.30 inch.

3. The payout tube according to claim 1, wherein:

each pillar includes a stiffener.

4. The payout tube according to claim 3, wherein:

the stiffener has a substantially V-shaped profile that protrudes from an exterior side of the pillar and is indented on an interior side of the pillar.

5. The payout tube according to claim 3, wherein:

the substantially V-shaped profile has a width that tapers down from the outer ring to the inner ring.

6. The payout tube according to claim 1, wherein:

the payout tube includes two diametrically opposed pillars.

7. A package of filamentary material wound in a figure-eight configuration, the package comprising:

a box or packaging defining a payout hole;

a coil of filamentary material wound into a figure-eight configuration defining a diamond shaped payout hole in alignment with the payout hole of the box or packaging; and a payout tube having an inner end and an outer end, the inner end disposed in an interior of the coil and the outer end extending outwardly from the payout hole of the coil, the payout tube having a flange at the outer end and having a rounded edge at the inner end, the rounded edge having a radius of between 0.20 inch and 0.30 inch and a plurality of spaced pillars extending longitudinally from the outer end to the inner end.

8. The package of claim 7, wherein:

the flange defines an exit opening for passage of the filamentary material, wherein the exit opening has a diameter of between 3.5 inches and 4 inches.

9. The package according to claim 8, wherein:

the payout tube includes two diametrically opposed pillars.

10. The package of claim 7, wherein:

the payout tube includes an outer ring having the flange at the outer end of the payout tube, the outer ring centered about a longitudinal axis, an inner ring having the rounded edge at the inner end of the payout tube, wherein the inner ring is coaxial with the outer ring and is spaced longitudinally from the outer ring, and the plurality of pillars extending longitudinally from the outer ring to the inner ring.

11. The package of claim 10, wherein:

each pillar includes a stiffener having a substantially V-shaped profile protruding from an exterior side of the pillar, wherein the substantially V-shaped profile aligns with a vertex of the diamond shaped payout hole.

12. The package of claim 7, wherein:

the box or packaging is a box having a length of 14 to 15 inches, a width of 9 to 10 inches, and height of 14 to 15 inches, the box having six sides with the payout hole defined in one side of the box.

* * * * *